US009988587B2

(12) United States Patent
Joshi et al.

(10) Patent No.: US 9,988,587 B2
(45) Date of Patent: Jun. 5, 2018

(54) PROCESS FOR REMOVAL OF NITROGEN FROM NATURAL GAS

(71) Applicant: FIELD UPGRADING LIMITED, Calgary (CA)

(72) Inventors: Ashok V Joshi, Salt Lake City, UT (US); Sai Bhavaraju, West Jordan, UT (US)

(73) Assignee: FIELD UPGRADING LIMITED, Calgary (CA)

( * ) Notice: Subject to any disclaimer, the term of this patent is extended or adjusted under 35 U.S.C. 154(b) by 344 days.

(21) Appl. No.: 14/812,888

(22) Filed: Jul. 29, 2015

(65) Prior Publication Data

US 2016/0032207 A1 Feb. 4, 2016

Related U.S. Application Data

(60) Provisional application No. 62/030,434, filed on Jul. 29, 2014.

(51) Int. Cl.
*C10L 3/10* (2006.01)

(52) U.S. Cl.
CPC ..... *C10L 3/105* (2013.01); *C10L 2290/12* (2013.01); *C10L 2290/38* (2013.01); *C10L 2290/54* (2013.01)

(58) Field of Classification Search
CPC ..... C10L 3/105; C10L 2290/54
See application file for complete search history.

(56) References Cited

U.S. PATENT DOCUMENTS 2,660,514 A 10/1953 Rohrman
5,399,246 A * 3/1995 Joshi ..... B01D 53/326 205/765

(Continued)

FOREIGN PATENT DOCUMENTS

EP 2276917 3/2012

OTHER PUBLICATIONS

Gloeckle, Markus "Bibliographic Data from EP2276917", European Patent EP2276917, (Jan. 26, 2011),1.

(Continued)

*Primary Examiner* — Ibrahime A Abraham
*Assistant Examiner* — Salil Jain
(74) *Attorney, Agent, or Firm* — Foley & Lardner LLP

(57) ABSTRACT

A method for removing nitrogen from natural gas includes contacting substantially dry natural gas that contains unwanted nitrogen with lithium metal. The nitrogen reacts with lithium to form lithium nitride, which is recovered for further processing, and pipeline quality natural gas. The natural gas may optionally contain other chemical species that may be reduced by lithium, such as carbon dioxide, hydrogen sulfide, and small amounts of water. These lithium reducible species may be removed from the natural gas concurrently with the removal of nitrogen. The lithium nitride is subjected to an electrochemical process to regenerate lithium metal. In an alternative embodiment, lithium nitride is reacted with sulfur to form lithium sulfide and nitrogen. The lithium sulfide is subjected to an electrochemical process to regenerate lithium metal and sulfur. The electrochemical processes are advantageously performed in an electrolytic cell containing a lithium ion selective membrane separator.

12 Claims, 5 Drawing Sheets

(56) References Cited

U.S. PATENT DOCUMENTS

| | | | | |
|---|---|---|---|---|
| 5,578,189 | A | 11/1996 | Joshi | |
| 2009/0134040 | A1* | 5/2009 | Gordon | C25B 1/00 205/560 |
| 2011/0100874 | A1 | 5/2011 | Gordon | |

OTHER PUBLICATIONS

Lee, Dong W., "International Search Report", PCT Application No. PCT/US2015/042734 (Corresponding to U.S. Appl. No. 14/812,888), (dated Sep. 22, 2015),1-5.

Lee, Dong W., "Written Opinion of the International Searching Authority", PCT Application No. PCT/US2015/042734 (Corresponding to U.S. Appl. No. 14/812,888), (dated Sep. 22, 2015),1-5.

* cited by examiner

PROCESS FOR REMOVAL OF NITROGEN FROM NATURAL GAS

CROSS-REFERENCE TO RELATED APPLICATIONS

This application claims the benefit of U.S. Provisional Patent Application Ser. No. 62/030,434, filed Jul. 29, 2014, and entitled "Novel Process For Removal Of Nitrogen From Natural Gas." The disclosure of the application to which the present application claims priority is incorporated by reference.

TECHNICAL FIELD

The present disclosure relates to a process for removing nitrogen from natural gas. More particularly, the disclosure relates to a method for the removal of nitrogen from natural gas by means of a chemical reaction with lithium metal, and the subsequent electrochemical regeneration of the lithium metal.

BACKGROUND

The demand for natural gas in the United States and worldwide energy markets is continually rising because it is viewed as a viable and clean alternative to traditional oil and coal. Natural gas is of particular importance because it is produced domestically and currently accounts for more than one-fifth of all the primary energy used in the United States. Furthermore, it is essential to the residential sector where it supplies nearly half of all the energy consumed in United States. The United States currently has proven natural gas reserves totaling 354 trillion cubic feet.

However, significant quantities of natural gas reserves in the United States cannot be produced economically because its quality is too low to be transported via existing pipeline infrastructure. Such low-quality natural gas contains significant concentration of gases other than methane. These non-hydrocarbons are predominantly nitrogen, water, carbon dioxide, and hydrogen sulfide, but may also include other gaseous components. These impurities significantly decrease the BTU value of the gas per unit volume and dramatically increase the transportation cost.

Most interstate pipeline systems in the United States have specifications that mandate the nitrogen content in the natural gas cannot exceed four to five percent. However, roughly fourteen percent of known gas reserves in the United States contain nitrogen in excess of the five percent threshold. These reserves either have a discounted market potential or are completely unmarketable due to the difficultly and cost inefficiency of removing the excess nitrogen. Consequently, there is a need to develop an efficient and cost effective method to improve the low-quality natural gas reserves in the United States.

Numerous attempts have been made to address the treatment of natural gas, and in particular, the removal of nitrogen, but these attempts can generally be divided into four major classification:

a. Methods for the low temperature and high pressure fractional distillation of low-quality natural gas.
b. Methods that utilize selectively nonporous membranes to separate the methane from other gas contaminants.
c. Methods for the adsorption of methane using activated charcoal as the methane adsorbent.
d. Methods that induce a chemical reaction between reactive elements and the nitrogen in the natural gas.

Although the aforementioned methods have achieved some success, in general the methods are too complex and prohibitively expensive at modest scale. Fractional distillation and adsorption methods are particularly inefficient because they remove the major component, methane, from the minor component, nitrogen, which increases cost and inefficiency. Similarly, methods using selectively nonporous membranes are economically inefficient and complex because they require low temperatures, and most membrane materials have low selectivity to methane and nitrogen. Finally, many of the existing methods require large centralized facilities to remove the nitrogen from the natural gas and exhibit poor scale down economics.

Within the chemical treatment of natural gas classification, U.S. Pat. No. 2,660,514 discloses one non-limiting example of a process for the removal of nitrogen. The disclosure includes a process for producing lithium nitride by the reaction of lithium amalgam with natural gas. The lithium nitride is subsequently reacted with water to produce ammonia and lithium hydroxide. The lithium hydroxide is then electrolyzed to regenerate the lithium amalgam.

Although the lithium amalgam method has been used to separate nitrogen from natural gas, it suffers from the following drawbacks: (1) lithium amalgam is not as efficient as lithium metal in removing nitrogen, (2) lithium amalgam contains mercury, and mercury is not preferred due to its hazardous nature, and (3) lithium hydroxide is a stable compound and it's electrolysis is an energy intensive process requiring high voltage (~4V). Moreover, the described process is applicable only for regeneration of lithium amalgam and not applicable for lithium metal.

In view of the multiple deficiencies of existing methods, there remains an unsatisfied need for a scalable, efficient, economical, and safe means of removing nitrogen from natural gas.

BRIEF SUMMARY

The present invention provides a process for removing nitrogen from natural gas. The overall process for the removal of nitrogen from natural gas includes both non-electrochemical and electrochemical reactions. The non-electrochemical reactions involve reacting lithium metal with substantially dried natural gas to produce lithium nitride. Additional non-electrochemical reactions will vary depending on the presence of chemically reducible species in the natural gas. For example, if hydrogen sulfide and carbon dioxide are present, then lithium polysulfide and lithium carbonate are also produced. If small amounts of water are present, then lithium hydroxide is produced. The present invention further provides an electrolytic process of regenerating the lithium metal from the resulting lithium nitride, and optionally produced reduced species such as lithium polysulfide, lithium carbonate, lithium hydroxide, etc.

One non-limiting embodiment within the scope of the invention includes a process for placing lithium nitride, and optionally produced lithium reduction products, such as lithium polysulfide, lithium carbonate, and/or lithium hydroxide, in an electrolytic cell to regenerate the lithium metal. The process utilizes an electrolytic cell having a lithium ion conductive membrane configured to selectively transport lithium ions. The membrane separates the electrolytic cell into an anolyte compartment configured with an anode and a catholyte compartment configured with a cathode.

An anolyte solution is introduced into the anolyte compartment. The anolyte solution includes the produced lithium nitride, and optionally produced lithium reduction products. The anolyte solution also includes an anolyte solvent that dissolves the relevant aforementioned lithium compounds. The anolyte solvent may include one of many non-aqueous solvents. Non-limiting examples of non-aqueous solvents include a low melting molten salt or an ionic liquid.

A catholyte solution is introduced into the catholyte compartment. The catholyte solution includes lithium metal ions and a catholyte solvent. The catholyte solvent may include one of many non-aqueous solvents. Non-limiting examples of non-aqueous solvents include a low melting molten salt or an ionic liquid. Applying an electric current to the electrolytic cell oxidizes the lithium nitride, and optionally present lithium polysulfide and/or lithium carbonate present in the anolyte compartment to form nitrogen, and optionally sulfur, oxygen, and carbon dioxide. The electric current further causes the lithium metal ions to pass through the lithium ion conductive membrane from the anolyte compartment to the catholyte compartment, and reduces the lithium metal ions in the catholyte compartment to form elemental lithium metal.

The present nitrogen, carbon dioxide, and oxygen gas and will be expelled, vented, or collected at operating temperatures. The optionally produced sulfur may be recovered by removing a portion of the anolyte solution from the anolyte compartment and then separating the precipitated sulfur from the anolyte solution.

By operating the cell at a temperature below the melting temperature of the lithium, elemental lithium will plate onto the cathode. The cathode may be periodically withdrawn from the catholyte compartment to remove the lithium metal. Alternatively, in one embodiment within the scope of the invention, the cathode may be configured to be continuously or semi-continuously removed from the cathode.

In an alternative embodiment, the carbon dioxide and hydrogen sulfide are scrubbed before contacting the natural gas with the lithium metal.

In another non-limiting embodiment, the lithium nitride is mixed with a low-melting molten salt, ionic-liquid or organic solvent to form a semi-solid paste. The semi solid paste is then placed in an undivided cell. The thermodynamic decomposition voltage of lithium nitride is very low because it has a relatively small formation enthalpy. Applying an electric potential to the undivided electrolytic cell oxidizes the lithium nitride to expel nitrogen gas and plate lithium metal at the cathode.

In one non-limiting embodiment, the lithium nitride is reacted with molten sulfur to convert it into lithium polysulfides. Lithium polysulfides are low melting compared to lithium nitride, which allows for the electrolysis to occur at lower temperatures. Lithium polysulfides are also more soluble in non-aqueous solvents compared to lithium nitride because of their less polar nature. The resulting nitrogen gas is expelled and the lithium polysulfide is transferred to an electrolytic cell. The electrolysis process utilizes an electrolytic cell having a lithium ion conductive membrane configured to selectively transport lithium ions. The membrane divides the electrolytic cell into an anolyte compartment configured with an anode and a catholyte compartment configured with a cathode.

An anolyte solution is introduced into the anolyte compartment. The anolyte solution includes the lithium polysulfide and an anolyte solvent. The anolyte solvent is selected to substantially dissolve the lithium polysulfide. Non-limiting examples of a possible anolyte solvent include organic solvents such as dimethyl ether and tetraglyme.

A catholyte solution is introduced into the catholyte compartment. The catholyte solution includes lithium metal ions and a catholyte solvent. Non-limiting examples of a possible catholyte solvent include room temperature ionic liquid solvents such as N-butyl-N-methylpyrrolidinium bis (fluoromethanesulfonyl)imide ($Pyr_{14}FSI$) containing dissolved LiFSI. Applying an electric current to the electrolytic cell oxidizes the lithium sulfide in the anolyte compartment to form elemental sulfur. It further causes the lithium metal ions to pass through the lithium ion conductive membrane from the anolyte compartment to the catholyte compartment, and reduces the alkali metal ions in the catholyte compartment to form elemental lithium metal.

The sulfur may be recovered by removing a portion of the anolyte solution from the anolyte compartment and then separating the precipitated sulfur from the anolyte solution.

The present invention may provide certain advantages, including but not limited to the following:

Chemically removing nitrogen and other optionally present impurities from natural gas in a single chemical reaction.

Operating an electrolytic cell to process the lithium nitride, and optional lithium reduction products at lower voltages.

Operating an electrolytic cell to process lithium nitride, and optional lithium reduction products at lower temperatures.

Removing the regenerated lithium continuously, semi-continuously or periodically in solid form from the cell.

Removing nitrogen and other optionally produced products such a carbon dioxide, oxygen and sulfur continuously, semi-continuously or periodically from the electrolytic cell.

These features and advantages of the present invention will become more fully apparent from the following description and appended claims, or may be learned by the practice of the invention as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE INVENTION

The present embodiments of the present invention will be best understood by reference to the drawings, wherein like parts are designated by like numerals throughout. It will be readily understood that the components of the present invention, as generally described and illustrated in the figures herein, could be arranged and designed in a wide variety of different configurations. Thus, the following more detailed description of the embodiments of the methods and cells of the present invention, as represented in FIGS. 1 through 5, is not intended to limit the scope of the invention, as claimed, but is merely representative of present embodiments of the invention.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment, but may refer to every embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

Figure 1:
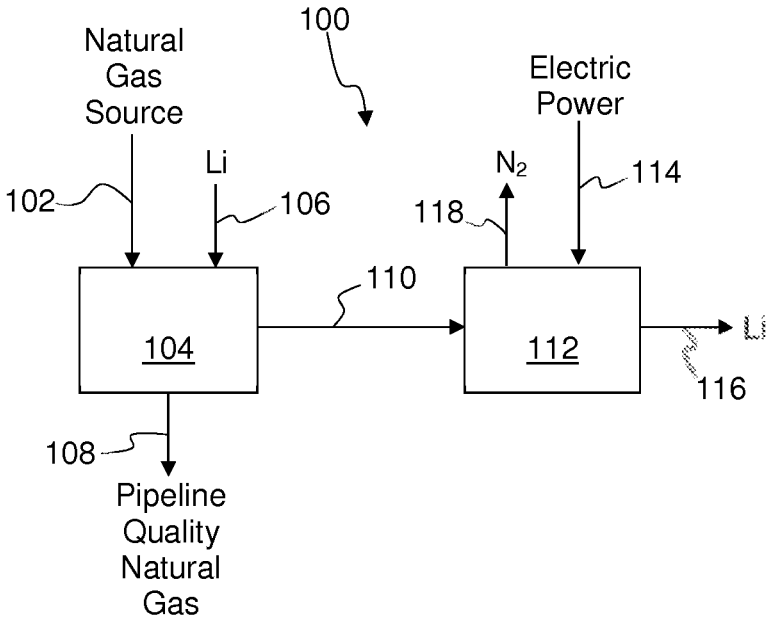
FIG. 1 shows an overall process for removing nitrogen from natural gas using lithium metal and for regenerating the lithium metal.

The overall process is shown schematically in FIG. 1 of one non-limiting embodiment for removing nitrogen from natural gas using lithium, and for regenerating the lithium metal. In the process 100 of FIG. 1, a natural gas source 102, defined as a substantially dried mixture of gaseous hydrocarbons containing nitrogen, is introduced into a reaction vessel 104. The natural gas source 102 may optionally contain lithium reducible species which are chemical species that may be reduced by lithium. Non-limiting examples of lithium reducible species include carbon dioxide, hydrogen sulfide, and small amounts of water that may be present in the natural gas. Lithium metal 106 is introduced into the reaction vessel 104. The lithium metal 106 reacts with nitrogen and any lithium reducible species present in the natural gas to form reaction products including lithium nitride and other lithium reduced species such as lithium carbonate, lithium polysulfide, and lithium hydroxide. This significantly reduces the amount of nitrogen and lithium reducible species present in the natural gas.

The pipeline quality natural gas 108 may be recovered from the reaction vessel.

The reaction products 110 may be further processed in an electrolytic cell 112 to regenerate and recover the lithium metal. The electrolytic cell 112 receives the reaction products 110, which may include lithium nitride and other lithium reduced species. Under the influence of a source of electric power 114, lithium metal ions are reduced to form lithium metal 116, which may be recovered and used as the source of lithium metal 106. The lithium reduced species undergo electrochemical oxidation reactions under the influence of the electric power source 114 to form nitrogen 118 and other products, such as carbon dioxide, oxygen and sulfur.

Figure 2:
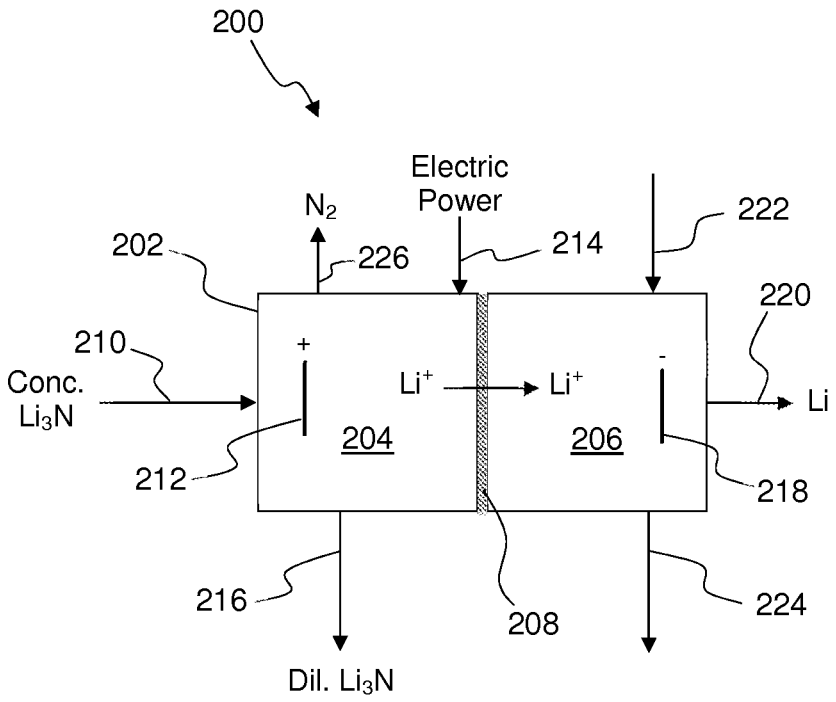
FIG. 2 shows one possible divided electrolytic cell that may be used in the electrochemical decomposition of lithium nitride.
Figure 3:
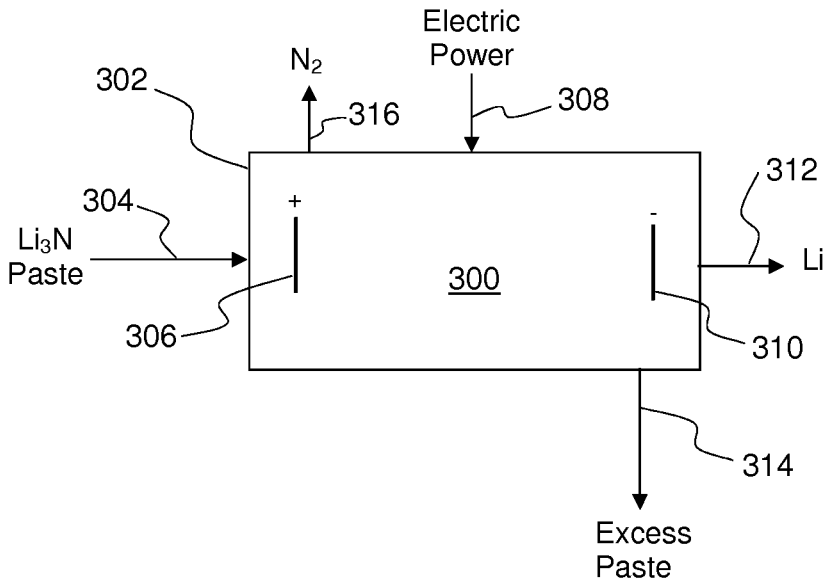
FIG. 3 shows one possible undivided electrolytic cell that may be used in the electrochemical decomposition of lithium nitride.

Other possible electrolytic cells used to regenerate and recover the lithium metal are illustrated in FIG. 2 and FIG. 3. FIG. 2 schematically shows one possible electrolytic cell 200 that may be used in the electrochemical process within the scope of the present invention. Referring to FIG. 2, the electrolytic cell housing 202 is constructed to contain the electrolytic cell reactants and component parts. The housing 202 is constructed of a material selected to be electrically insulative and chemically resistant to solvents. The cell housing 202 may also be fabricated from a non insulative material and non-chemically resistant material, provided the interior of the housing 202 is lined with such an insulative and chemically resistant material.

The internal space of housing 202 is divided into an anolyte compartment 204 and catholyte compartment 206 by a divider 208. The divider 208 is substantially permeable only to cations and substantially impermeable to anions and dissolved sulfur, nitrogen and carbon dioxide. In one embodiment the divider is fabricated from a microporous material, such as a polymer or a porous ceramic. In another embodiment, the divider is fabricated using a lithium ion conductive membrane selected from a LiSICON (e.g. $Li_{1+x}Ti_{2-x}Al_x(PO_4)_3$), perovskite (e.g. lithium lanthanum titanate $La_{2/3-x}Li_{3x}TiO_3$, ($0<x<0.16$)), garnet (e.g. $Li_7La_3Zr_2O_{12}$), lithium ion conducting glasses (e.g. $Li_3PS_4$) and polymeric ion-exchange type membrane. The electrolytic cell 200 is operated by feeding a solution 210 containing lithium nitride, and optionally lithium polysulfide, lithium carbonate, and/or lithium hydroxide, into the anolyte compartment 204.

The solution 210 may be created by dissolving the lithium nitride, and optionally present other lithium reduced species, in a low melting molten salt or ionic liquid. Non-limiting examples of molten salts used for dissolving lithium nitride include lithium halo-aluminates, eutectics of lithium halides and non-lithium alkali metal halides, and molten lithium bis(fluorosulfonyl) imides. Non-limiting examples of ionic liquids include N-methyl-N-alkylpyrrolidinium, bis(trifluoromethanesulfonyl)amide and 1-alkyl-3-methylimidazolium tetrafluoroborate. The concentration of lithium nitride and other lithium reduced species such as lithium polysulfide, lithium carbonate or a combination thereof within the solution 210 may range from 1 to 30% by weight.

The anode 212 is located within the anolyte compartment 204. It may be fabricated from an electrically conductive material. Non-limiting examples of conductive anode material include stainless steel, nickel, iron, iron alloys, nickel alloys, and other anode materials known in the art. The anode 212 is connected to the positive terminal of a direct current power supply 214. The anode 212 may be a mesh, porous, monolithic structure or may be a monolith with features to allow passage of nitrogen through the anode structure. The anolyte solution 210 is fed into an anolyte inlet and passes out of the compartment through an outlet 216. The electrolytic cell 200 can also be operated in a semi-continuous fashion where the anolyte compartment is fed and partially drained through the same passage.

The electronically conductive cathode 218 is located within the catholyte compartment 206. The cathode may also be fabricated of any suitable cathode material that allows the cell to reduce lithium ions. In this regard, some examples of suitable cathode material include nickel, copper, titanium, stainless steel, graphite, other forms of carbon, KOVAR and any other suitable cathode material. This allows the lithium metal to plate onto the cathode 218. Construction of the cathode may allow the lithium to be removed from the cathode continuously, semi-continuously or periodically as shown by arrow 220.

The cathode 218 is polarized by a connection to the negative terminal of the electric power supply 214. The catholyte compartment 206 may have an inlet port 222 and an outlet port 224 to transfer catholyte solution in and out of the catholyte compartment 206 when required.

The catholyte solution may comprise a lithium ion conductive liquid. The lithium ion conductive liquid may include a polar solvent. Non-limiting examples of suitable polar solvents are tetraglyme, diglyme, dimethyl carbonate, dimethoxy ether, propylene carbonate, ethylene carbonate, diethyl carbonate and such. An appropriate lithium metal salt, such as a lithium chloride, lithium bromide, lithium iodide, lithium perchlorate, lithium hexafluorophosphate, is dissolved in the polar solvent to form the catholyte solution. Another non-limiting example of a possible catholyte lithium ion conductive liquid include room temperature ionic liquid solvents such as N-butyl-N-methylpyrrolidinium bis(fluoromethanesulfonyl)imide ($Pyr_{14}FSI$) containing dissolved LiFSI.

The following typical reactions may occur in the electrolytic cell 200:

At the anode 212:

$$2Li_3N \rightarrow 6Li^+ + N_2 + 6e^-$$

$$Li_2S_x \rightarrow 2Li^+ + S_x + 2e^-$$, where x ranges from 0 to about 8.

$$Li_2CO_3 \rightarrow 2Li^+ + CO_2 + \tfrac{1}{2}O_2 + 2e^-$$

At the cathode:

$$6Li^+ + 6e^- \rightarrow 6Li$$

Subsequently, the nitrogen 226, and optionally present sulfur, carbon dioxide and oxygen or combination thereof is removed from the undivided cell and recovered.

FIG. 3 schematically shows one possible electrolytic cell 300 that may be used in the electrochemical process within the scope of the present invention. Referring to FIG. 3, the electrolytic cell housing 302 is constructed to enclose a semi-solid paste. The housing 302 is fabricated of a material that is preferably electrically insulative and chemically resistant to solvents. The cell housing 302 may also be fabricated from a non-insulative material and non-chemically resistant material, provided the interior of the housing 302 is lined with such an insulative and chemically resistant material.

The internal space of housing 302 is undivided. The electrolytic cell 300 is operated by placing a semi-solid paste 304 containing the lithium nitride, and optionally present lithium polysulfide and/or lithium carbonate into the undivided cell 300.

The semi-solid paste may be created by mixing the lithium nitride, and optionally present other lithium reduced species, in a low melting molten salt, ionic liquid or organic solvent. Examples of non-limiting molten salts include: lithium halo-aluminates, eutectics of lithium halides and non-lithium alkali metal halides, and molten lithium bis(fluorosulfonyl) imides. Non-limiting examples of ionic liquids include N-methyl-N-alkylpyrrolidinium, bis(trifluoromethanesulfonyl)amide and 1-alkyl-3-methylimidazolium tetrafluoroborate. Non-limiting examples of organic solvents include dimethyl ether and tetraglyme.

The anode 306 is located within the undivided cell 300. It may be fabricated from an electrically conductive material. Non-limiting examples of electrically conductive anode material includes stainless steel, nickel, iron, iron alloys, nickel alloys, and other anode materials known in the art. The anode 306 is connected to the positive terminal of a direct current power supply 308. The anode 306 may be a mesh, porous, monolithic structure or may be a monolith with features to allow passage of nitrogen through the anode structure.

The electronically conductive cathode 310 is located within the undivided cell 300. The cathode may also be fabricated of any suitable cathode material that allows the cell to reduce lithium ions. In this regard, some examples of suitable cathode material include nickel, copper, titanium, stainless steel, graphite, other forms of carbon, KOVAR and any other suitable cathode material. This allows the lithium metal to plate onto the cathode 310. Construction of the cathode 310 allows the lithium to be removed from the cathode continuously, semi-continuously or periodically 312. The cathode 310 is polarized by a connection to the negative terminal of the electric power supply 308.

The semi-solid paste is fed into the undivided cell at an inlet 304 and passes out of the compartment through an outlet 314. The electrolytic cell 300 can also be operated in a semi-continuous fashion where the undivided cell is fed and partially drained through the same passage. The thermodynamic decomposition voltage of $Li_3N$ is very low, 0.44 V vs. Li because it has a relatively small formation enthalpy ($\Delta G_r$) of −129 kJ/mol. This implies that it is fairly easy to decompose on application of voltage even in undissociated state.

The following typical reactions may occur in the electrolytic cell 300:

At the anode:

$$2Li_3N \rightarrow 6Li^+ + N_2 + 6e^-$$

$$Li_2S_x \rightarrow 2Li^+ + S_x + 2e^-$$, where x ranges from 0 to about 8.

$$Li_2CO_3 \rightarrow 2Li^+ + CO_2 + \tfrac{1}{2}O_2 + 2e^-$$

At the cathode:

$$6Li^+ + 6e^- \rightarrow 6Li$$

The nitrogen, and optionally produced sulfur, carbon dioxide and oxygen or combination thereof are removed from the undivided cell and recovered 316.

Another non-limiting embodiment of a process within the scope of the present invention is like the one disclosed above, except the lithium nitride is treated with molten sulfur to convert it to lithium polysulfide.

Figure 4:
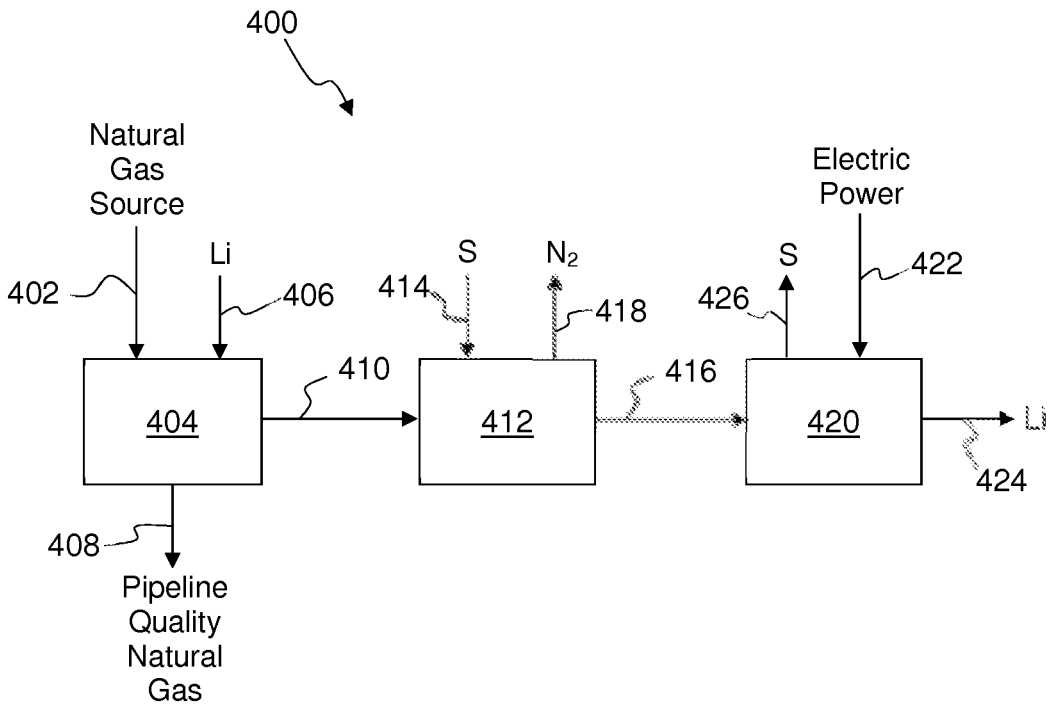
FIG. 4 shows an overall process for removing nitrogen from natural gas using both lithium metal and molten sulfur, and for regenerating the lithium metal and sulfur.

In the process 400 of FIG. 4, a natural gas source 402, defined as a substantially dried mixture of gaseous hydrocarbons containing nitrogen, is introduced into a reaction vessel 104. The natural gas source 402 may optionally contain lithium reducible species which are chemical species that may be reduced by lithium. Non-limiting examples of lithium reducible species include carbon dioxide, hydrogen sulfide, and small amounts of water that may be present in the natural gas. Lithium metal 406 is also introduced into a reaction vessel 404. The lithium metal 406 reacts with nitrogen and any lithium reducible species present in the natural gas to form reaction products including lithium nitride and other lithium reduced species such as lithium carbonate, lithium polysulfide, and lithium hydroxide. This significantly reduces the amount of nitrogen and lithium reducible species present in the natural gas.

The pipeline quality natural gas, 408 may be vented and recovered from the reaction vessel. The reaction products 410 are transferred to a secondary vessel 412. Molten sulfur 414 is introduced into the secondary reaction vessel 412. Within the secondary vessel 412, the lithium nitride and molten sulfur react to produce lithium polysulfide according to the following initial reaction:

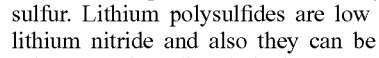

$$2Li_3N+S_6 \rightarrow 3Li_2S_2+N_2$$

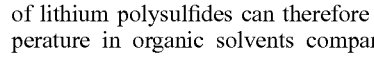

$$2Li_3N+2S_6 \rightarrow 3Li_2S_4+N_2$$

The produced lithium polysulfides 416 may be transferred to and further processed in an electrolytic cell to recover the sulfur. Lithium polysulfides are low melting compared to lithium nitride and also they can be dissolved in organic solvents such as dimethyl ether, tetraglyme etc. Electrolysis of lithium polysulfides can therefore happen at lower temperature in organic solvents compared to lithium nitride requiring molten salts and ionic liquids. Analogously, lithium nitride can be treated with iodine (instead of sulfur) to form lithium iodide which can then be dissolved in organic solvents to regenerate Li metal by electrochemical methods as disclosed herein.

The produced nitrogen 418 is vented from the secondary reaction vessel 412 at operating temperatures, and may be recovered.

The electrolytic cell 420 receives the lithium polysulfide 416. Under the influence of a source electric power 422, lithium metal ions are reduced to form lithium metal 424, which may be recovered and used as a source of lithium metal 406. Sulfur 426 is also recovered from the process of the electrolytic cell 420, and can be used a sulfur source 414. A detailed discussion of a possible electrolytic cell is given in FIG. 5.

Figure 5:
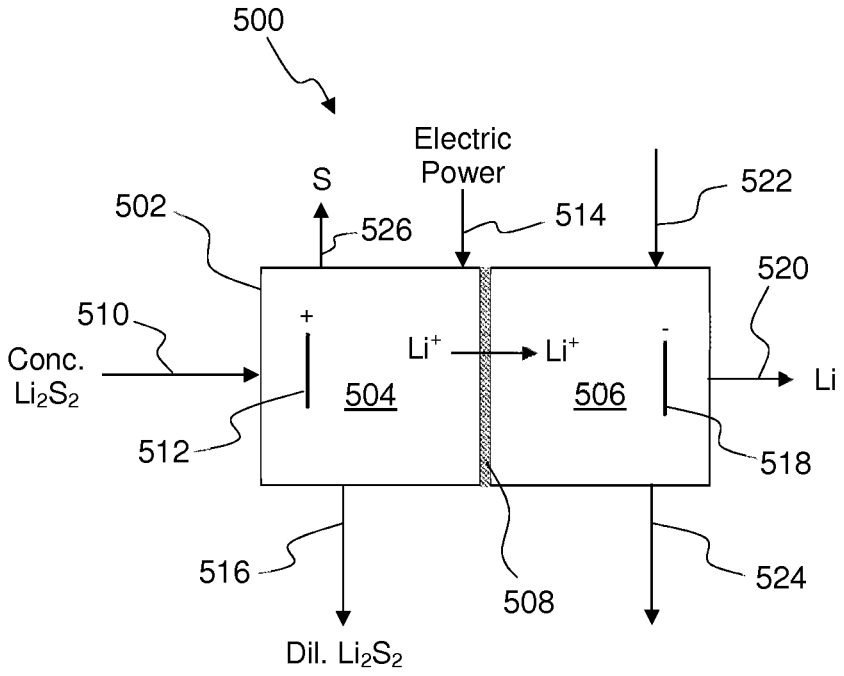
FIG. 5 shows one possible divided electrolytic cell that may be used in the electrochemical decomposition of lithium polysulfide.

FIG. 5 schematically shows one possible electrolytic cell 500 that may be used in the electrochemical process within the scope of the present invention. Referring to FIG. 5, the electrolytic cell housing 502 is constructed to contain the electrolytic cell reactants and component parts. The housing 502 may be fabricated of a material that preferably is an electrically insulative and chemically resistant to solvents. The cell housing 502 may also be fabricated from a non-insulative material and non-chemically resistant material, provided the interior of the housing 502 is lined with such an insulative and chemically resistant material.

The internal space of housing 502 is divided into an anolyte compartment 504 and a catholyte compartment 506 by a divider 508. The divider 508 is substantially permeable only to cations and substantially impermeable to anions and dissolved sulfur, nitrogen and carbon dioxide. In one embodiment the divider 508 is fabricated from a microporous material such as a polymer or a porous ceramic. In another embodiment, the divider 508 is fabricated using a lithium ion conductive membrane selected from a LiSICON, perovskite, garnet, Li ion conducting glasses and polymeric ion-exchange type membrane. The electrolytic cell 500 is operated by feeding a solution 510 containing lithium polysulfide into the anolyte compartment 504.

This solution 510 can be created by dissolving the lithium polysulfide in an anolyte solvent. The anolyte solvent may be selected from solvents that substantially dissolve lithium polysulfide. Non-limiting examples of possible anolyte solvents include organic solvents such as dimethyl ether or tetraglyme. The concentration of lithium polysulfide within the solvent may range from 1 to 30% by weight.

The anode 512 is located within the anolyte compartment 504. It may be fabricated from an electrically conductive material such as stainless steel, nickel, iron, iron alloys, nickel alloys, and other anode materials known in the art. The anode 512 is connected to the positive terminal of a direct current power supply 514. The anode 512 may be a mesh, porous, monolithic structure or may be a monolith with features to allow passage through the anode structure. Anolyte solution is fed into an anolyte inlet 510 and passes out of the compartment through an outlet 516. It will be appreciated that the concentration of lithium sulfide is higher in the solution fed through the anolyte inlet 510 compared to the solution exiting through the outlet 516. The electrolytic cell 500 can also be operated in a semi-continuous fashion where the anolyte compartment is fed and partially drained through the same passage.

The electronically conductive cathode 518 is located within the catholyte compartment 506. The cathode may also be fabricated of any suitable cathode material that allows the cell to reduce lithium ions. In this regard, some examples of suitable cathode material include nickel, copper, titanium, stainless steel, graphite, other forms of carbon or KOVAR without limitation. This allows the lithium metal to plate onto the cathode 518. The construction of the cathode allows the lithium to be removed from the cathode continuously, semi-continuously or periodically 520.

The cathode 518 is polarized by a connection to the negative terminal of a power supply 514. The catholyte compartment 506 may have an inlet port 522 and an outlet port 524 to transfer catholyte solution in and out of the catholyte compartment 506 when required.

The catholyte solution may comprise a lithium ion conductive liquid. The lithium ion conductive liquid may include a polar solvent. Non-limiting examples of suitable polar solvents are tetraglyme, diglyme, dimethyl carbonate, dimethoxy ether, propylene carbonate, ethylene carbonate, diethyl carbonate and such. An appropriate lithium metal salt, such as a lithium chloride, lithium bromide, lithium iodide, lithium perchlorate, lithium hexafluorophosphate, is dissolved in the polar solvent to form the catholyte solution.

The following typical reactions may occur in the electrolytic cell 500:

At the anode:

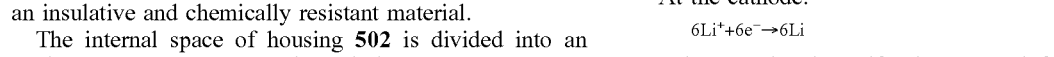

$$Li_2S_x \rightarrow 2Li^+ + S_x + 2e^-$$, where x ranges from 0 to about 8.

At the cathode:

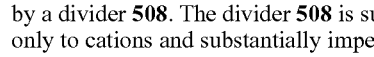

$$6Li^+ + 6e^- \rightarrow 6Li$$

Subsequently, the sulfur is removed from the anolyte compartment and recovered 526.

In view of the foregoing, it will be appreciated that the disclosed invention includes one or more of the following advantages:

Efficiently and cost effectively removing nitrogen and other impurities from natural gas in a single reaction.

Operating an electrolytic cell to process lithium nitride, and optionally lithium carbonate and/or lithium polysulfide at temperatures below the melting temperature of lithium.

Operating an electrolytic cell continuously, semi-continuously or periodically to process the lithium nitride, and optionally lithium carbonate and/or lithium polysulfide at temperatures below the melting temperature of lithium.

Removing the regenerated lithium metal continuously, semi-continuously or periodically in solid form from the cell.

Operating the electrolytic cells at low temperatures and pressures, so that the electrolytic cell materials of construction can include materials which would not tolerate elevated temperature.

While specific embodiments of the present invention have been illustrated and described, numerous modifications come to mind without significantly departing from the spirit of the invention, and the scope of protection is only limited by the scope of the accompanying claims.

The invention claimed is:

1. A method for removing nitrogen from combustible gas comprising:

providing a substantially dry natural gas containing nitrogen;

contacting the dry natural gas with lithium metal to cause the nitrogen to react with lithium to form lithium nitride;

recovering the lithium nitride;

contacting the lithium nitride with molten sulfur to produce nitrogen gas and lithium sulfide;

recovering the lithium sulfide;

disposing the lithium sulfide into an electrolytic cell, comprising an anode and a cathode electrically connected to a source of electric potential; and applying an electric potential to the electrolytic cell to oxidize the lithium sulfide at the anode to produce sulfur, and to reduce lithium ions at the cathode to produce lithium metal.

2. The method of claim 1, wherein the electrolytic cell comprises of a lithium ion selective separator that divides the electrolytic cell between an anolyte compartment containing an anode, and a catholyte compartment containing a cathode.

3. The method of claim 1, wherein the lithium sulfide is dissolved in an organic solvent selected from dimethyl ether or tetraglyme.

4. The method of claim 1, wherein the separator is microporous polymer separator.

5. The method of claim 1, wherein the separator is a microporous ceramic separator.

6. The method of claim 1, wherein the separator is a LiSICON membrane.

7. The method of claim 1, wherein there is little or no gap between the cathode and lithium ion selective separator.

8. The method of claim 1, wherein the cathode is fabricated of a cathode material selected from nickel, copper, titanium, stainless steel, and carbonaceous materials.

9. The method of claim 1, wherein the anode is porous.

10. The process according to claim 1, wherein the anode is fabricated of an anode material selected from stainless steel, carbon steel, nickel-cobalt-ferrous, platinum, lead dioxide, and carbonaceous materials.

11. The method of claim 1, wherein molten sulfur is replaced with iodine.

12. The method of claim 1, wherein the natural gas further comprises one or more lithium reducible species selected from carbon dioxide, hydrogen sulfide, water and mixtures thereof.

* * * * *